US005961318A

United States Patent [19]

Chambers et al.

[11] Patent Number: 5,961,318

[45] Date of Patent: Oct. 5, 1999

[54] METHOD AND APPARATUS FOR REDUCING FUEL FLOW TO A CANDLE WICK

[75] Inventors: Gregory V. Chambers, Scottsdale, Ariz.; Mohamed Elsamaloty; Michael C. Cole, both of Wilmington, Ohio

[73] Assignee: The Dial Corporation, Scottsdale, Ariz.

[21] Appl. No.: 09/007,942

[22] Filed: Jan. 16, 1998

[51] Int. Cl.[6] ..... F23D 3/24

[52] U.S. Cl. ..... 431/320; 431/291

[58] Field of Search ..... 431/291, 320, 431/298, 289, 288

[56] References Cited

U.S. PATENT DOCUMENTS

| | | |
|---|---|---|
| Re. 24,423 | 2/1958 | Oesterle et al. . |
| 1,174,934 | 3/1916 | Hawkins et al. . |
| 1,184,511 | 5/1916 | Bourgeois . |
| 1,267,968 | 5/1918 | Bulle . |
| 1,344,446 | 6/1920 | Engman . |
| 1,367,921 | 2/1921 | Pomije . |
| 1,660,760 | 2/1928 | Murphy . |
| 1,867,420 | 7/1932 | Root . |
| 2,137,707 | 11/1938 | Wade et al. . |
| 2,240,071 | 4/1941 | Gisolfi . |
| 2,274,823 | 3/1942 | Candy, Jr. . |
| 2,291,067 | 7/1942 | Atkins . |
| 2,291,072 | 7/1942 | Dahle . |
| 2,340,527 | 2/1944 | Guilfoil, Jr. . |
| 2,481,019 | 9/1949 | Joyce . |
| 2,713,256 | 7/1955 | Oesterle et al. . |
| 2,818,718 | 1/1958 | Roberts . |
| 2,859,604 | 11/1958 | Hallum . |
| 3,105,373 | 10/1963 | De Villemure et al. . |
| 3,286,492 | 11/1966 | Frazier, Jr. . |
| 3,428,409 | 2/1969 | Summers . |
| 3,462,235 | 8/1969 | Summers . |
| 3,797,990 | 3/1974 | Rogers et al. . |
| 3,998,922 | 12/1976 | Weiss . |
| 4,134,718 | 1/1979 | Kayfetz et al. ..... 431/320 |
| 4,332,548 | 6/1982 | Linton et al. . |
| 4,529,376 | 7/1985 | Cafolla . |
| 4,917,597 | 4/1990 | Henze . |
| 5,057,005 | 10/1991 | Kwok . |
| 5,127,825 | 7/1992 | Tendick, Sr. . |

FOREIGN PATENT DOCUMENTS

| | | |
|---|---|---|
| 2706103 A1 | 8/1978 | Germany . |
| 1335 | 4/1873 | United Kingdom . |
| 22640 | 4/1912 | United Kingdom . |

*Primary Examiner*—Carroll B. Dority
*Attorney, Agent, or Firm*—Snell & Wilmer L.L.P.

[57] ABSTRACT

The present invention includes a wick holder, whereby the upper portion of the ferrule is "S" crimped, without piercing the ferrule, to reduce the flow of fuel upward through the ferrule. The bottom of the base, on the opposite side of the cylindrical ferrule, is completely sealed off by a hot-melt adhesive, thereby preventing fuel from traveling up the hollow ferrule. By reducing the flow of fuel within the present wick holder, the wick holder restricts the supply of fuel to the candle wick when the flame burns the candle wick down to the top of the wick holder ferrule. By restricting the supply of fuel to the wick, the candle flame, upon burning down to the top of the wick holder, self-extinguishes before allowing the flame to approach the surface of the glass candle holder.

11 Claims, 1 Drawing Sheet

METHOD AND APPARATUS FOR REDUCING FUEL FLOW TO A CANDLE WICK

TECHNICAL FIELD

The present invention relates, generally, to a method and apparatus for automatically extinguishing a flame at a predetermined point on a candle wick, and more particularly, to a method and apparatus for restricting the fuel flow to the lower end of a candle wick.

BACKGROUND ART AND TECHNICAL PROBLEMS

In a typical candle arrangement, the flame receives fuel from the molded or dipped mass of wax surrounding the wick. As long as the fuel is supplied, through the wick via a capillary action, to the flame, the flame continually burns down the wick. In many situations, the candle is lit and left alone to burn until the candle is manually extinguished or extinguishes itself. A typical candle will normally extinguish itself upon the disintegration of the wick or the elimination of the fuel supply to the wick.

Many commercially sold wax candles, however, are often placed or formed in a glass or other fragile non-flammable container. Therefore, as the flame disintegrates the wick, the flame approaches the bottom of the glass candle holder, thereby causing the glass holder to experience excessive heating. In certain conditions, the excessive heating results in thermally induced cracking or breakage failures. Specifically, when the heat inside the glass container exceeds the heat stress limits of the glass container, the glass may crack or completely break. If a glass candle holder breaks, flying glass pieces, fire hazards, and burns from picking up hot pieces of glass and wax may result in various levels of injury.

Typical candles will often self-extinguish when less than approximately 0.25 inches of wax residue is left in the bottom of the glass holder. However, allowing a candle to burn with only 0.25 inches of wax residue between the flame and bottom of the glass is often dangerous in that, as discussed above, the flame still provides excessive heat to the glass surface. To further separate the flame from the glass surface and to provide stability to the wick, the bottom end of the wick is typically inserted into a wick clip. An exemplary wick clip (See FIG. 1) is often constructed of a thin metal or aluminum material which includes a wide base for supporting a hollow cylindrical ferrule, whereby the cylindrical ferrule is typically located in the center of the base. The center of the base often includes an opening allowing fuel access from underneath the base into the hollow ferrule.

Due to the fuel's easy access into the wick clip, the wick continues to burn inside the wick clip, thereby allowing the hot flame to further approach the glass holder. In prior art wick clips, the fuel enters from the top of the ferrule or from underneath through the opening in the wick clip base. Thus, a method and apparatus is needed which overcomes the shortcomings of the prior art by automatically extinguishing the wick when it burns down to a predetermined height above the bottom of the candle holder.

SUMMARY OF THE INVENTION

The present invention includes a wick holder formed from a round base with a cylindrical ferrule emanating from the center of the round base. The cylindrical ferrule is hollow as to allow one end of the wick to be reciprocally received therein. The upper portion of the ferrule is "S" crimped, without piercing the ferrule, to reduce the flow of fuel upward through the ferrule. The base of the wick holder includes a small opening in the center of the base which is concentric with, and the same diameter as, the opening in the cylindrical ferrule. The bottom of the base, on the opposite side of the cylindrical ferrule, is completely sealed off by a hot-melt adhesive, thereby preventing fuel from traveling up the hollow ferrule.

By reducing the flow of fuel within the present wick holder, the wick holder restricts the supply of fuel to the candle wick when the flame burns the candle wick down to the top of the wick holder ferrule. By restricting the supply of fuel to the wick, the candle flame, upon burning down to the top of the wick holder, self-extinguishes before allowing the flame to approach the surface of the glass candle holder.

BRIEF DESCRIPTION OF THE DRAWING FIGURES

The present invention will hereinafter be described in conjunction with the appended drawing figures, wherein like numbers denote like elements, and:

DETAILED DESCRIPTION OF PREFERRED EXEMPLARY EMBODIMENTS

Figure 1:
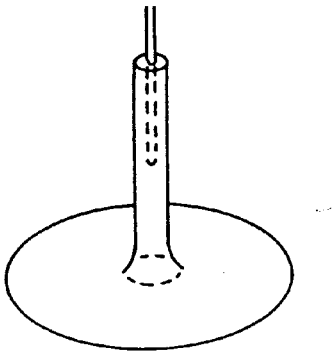
FIG. 1 PRIOR ART
FIG. 1 shows an exemplary prior art wick clip.
Figure 2:
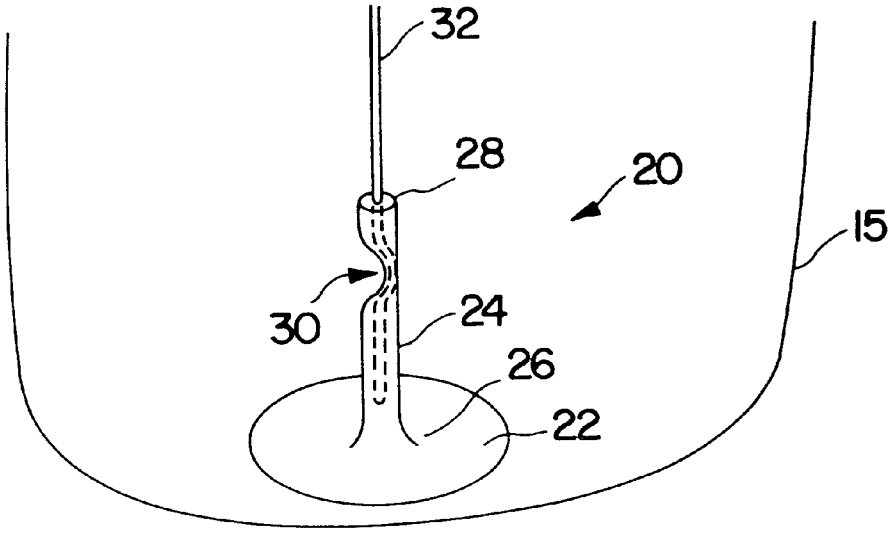
FIG. 2 shows a side view of a preferred embodiment of the present invention; and, FIG. 3 shows a bottom view of a preferred embodiment of the present invention.

The present invention, generally, includes a device which supports a wick 32, but substantially restricts the flow of fuel to the lower end of the wick. The device may be comprised of various configurations as known to one skilled in the art. For example, the device may simply include a post without any base member. As shown in FIG. 2, a preferred exemplary embodiment of the present invention includes a wick holder 20 preferably formed from a base 22 with a cylindrical ferrule 24 emanating from the center of base 22. Ferrule 24 is preferably integrally formed with base 22 by a known draw-redraw process. Alternatively, base 22 and ferrule 24 can be two separate pieces attached by any suitable means. For example, base 22 and ferrule 24 can be joined by soldering, glue, and/or the like. Base 22 can also reciprocally receive second end 26 of ferrule 24. Additionally, base 22 can alternatively be of any shape and formed of any suitable material. In a preferred embodiment, base 22 is substantially round and formed of tin.

With continued reference to FIG. 2, in a preferred embodiment, ferrule 24 is cylindrical and the height of ferrule 24 is about ½", thereby providing ample spacing between the flame and holder 15. Holder 15 is any device known in the art capable of holding wax around ferrule 24, but withstanding the increased temperatures associated with candle flames. Holder 15 is typically glass, ceramic or the like. Ferrule 24 is preferably formed of tin and preferably hollow so as to allow one end of a wick 32 to be reciprocally received therein. Alternatively, ferrule 24 can be of any shape and formed of any suitable material. As an alternative embodiment, ferrule 24 is a solid ferrule having wick 32 attached to first end 28 of ferrule 24 or having wick 32 integrated into ferrule 24 during molding of ferrule 24. Candle wick 32 is preferably comprised of a soft cotton embroidery yarn, but wick 32 may be any suitable combustible material.

In a preferred embodiment of FIG. 2, after partially inserting one end of wick 32 into ferrule 24, the upper portion of ferrule 24 is "S" crimped, without piercing the ferrule, but still bending and pinching wick 32 against the inner wall of ferrule 24, thereby substantially reducing the flow of fuel upward through ferrule 24. In an alternative embodiment, the "S" crimp can be located on any point along the length of ferrule 24 and the crimp can be any shape which substantially reduces fuel flow through ferrule 24. In an alternative embodiment, substantial reduction of fuel flow through ferrule 24 is accomplished by any means which restricts the opening within ferrule 24. For example, a small cork stopper inserted into the opening of ferrule 24 and pinching wick 32 against the inner wall of ferrule 24. Furthermore, the aforementioned candle fuel preferably includes a wax composition, and alternatively, includes any flammable liquid and/or other flammable substances.

Figure 3:
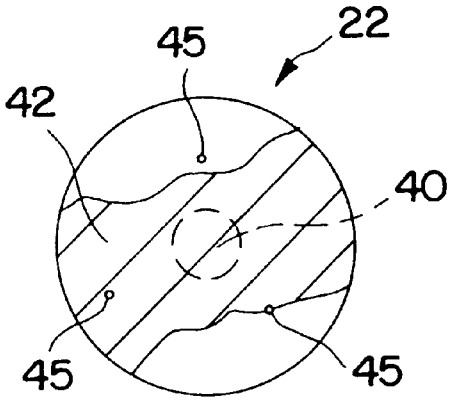

With respect to FIG. 3, base 22 includes a top side from which ferrule 24 emanates and a bottom side which is typically placed against the inside bottom of holder 15. In a preferred embodiment, the center of base 22 includes an opening 40 which is concentric with, and substantially the same diameter as, the opening of the second end 26 of ferrule 24. The bottom of base 22, on the opposite side from which ferrule 24 emanates, is preferably substantially sealed off by a hot-melt adhesive 42, thereby preventing fuel from traveling through opening 40, and eventually up into ferrule 22 containing wick 32. Adhesive 42 may also be used to affix wick holder 20 to holder 15. Hot-melt adhesive 42 has a melting point of about 350° F. degrees, while a typical candle wax melts at around 150° F. degrees; therefore, the molten candle wax does not cause adhesive 42 to melt. In an alternative embodiment, opening 40 is sealed by any suitable material capable of substantially restricting fuel from entering ferrule 24. For example, opening 40 is substantially sealed by any adhesive, metal plate, tape, plastic and/or the like. In another alternative embodiment, base 22 is formed without an opening 40.

The bottom of base 22 also preferably includes three small protruding legs 45, equally spaced about the bottom of base 22, thereby elevating base 22 slightly above the surface upon which base 22 rests. Elevating base 22 further insulates the glass container (which holds the candle) from the heat of the candle flame.

When a candle is burning, as the flame disintegrates wick 32, the flame approaches the bottom of glass candle holder 15, thereby increasing the temperature of glass holder 15. In a preferred embodiment, by substantially sealing wick holder 20 and "S" crimping ferrule 24, the flow of fuel is substantially reduced within ferrule 24. Because the flow of fuel is restricted within ferrule 24, the wick needs to be supplied with fuel in an alternative manner. While the wick is burning, the capillary action draws the melted wax horizontally from the top layer of the wax, towards wick 32, then up the wick to the flame.

Accordingly, when the candle flame burns candle wick 32 down to first end 28 of ferrule 24 and melts the wax around wick 32, wick holder 20 substantially restricts the supply of the molten wax to candle wick 32. By restricting the supply of fuel to wick 32, the candle flame, upon burning down to first end 28 of wick holder 20, self-extinguishes before the approaches the bottom surface of glass candle holder 15. Restricting the flame from approaching glass holder 15 prevents excessive heating of candle holder 15 and prevents possible thermally induced cracking or breakage failures of holder 15. Moreover, depending on the height of wick holder 20, wick holder 20 substantially prevents a sufficient amount of solid wax from being burned up by the flame. Therefore, during the entire life of the flame, a sufficient amount of solid wax will remain in the bottom of candle holder 15, thereby further providing an insulating barrier between the flame and glass holder 15, thus reducing the dangerous heat transfer to holder 15.

Although the invention has been described herein with reference to the appended drawing figures, it will be appreciated that the scope of the invention is not so limited. Various modifications in the sequence of steps and arrangement of components may be made without departing from the spirit and scope of the invention as set forth in the appended claims.

We claim:

1. A wick holder including a ferrule, said ferrule having a length and configured to reciprocally receive a predetermined portion of a wick, said ferrule configured to substantially restrict a flow of fuel to said wick.

2. The wick holder of claim 1 further including a coating, said coating substantially preventing said fuel from contacting said portion of said wick contained in said wick holder.

3. The wick holder of claim 2, wherein said coating includes at least one of adhesive, metal, tape, plastic and polyeurethane.

4. The wick holder of claim 1, wherein said length of said ferrule including at least one crimp.

5. The wick holder of claim 4 wherein said crimp includes an "S" crimp.

6. The wick holder of claim 1, wherein said length of said ferrule is about ½".

7. A method for substantially restricting the flow of fuel to a wick including the steps of:

providing a wick holder including a ferrule and a base, said ferrule having a length;

inserting a predetermined portion of said wick into said ferrule; and, crimping a predetermined point on said length of said ferrule.

8. The method of claim 7 further including coating said base of said wick holder, thereby substantially preventing said fuel from contacting said portion of said wick contained in said wick holder.

9. The method of claim 8, wherein said coating step includes coating said wick holder with at least one of adhesive, metal, tape, plastic and polyeurethane.

10. The method of claim 7, wherein said crimping step includes "S" crimping a predetermined point on said length of said ferrule.

11. The method of claim 7, wherein said step of providing a wick holder including a ferrule includes providing a ferrule having a length of about ½".

* * * * *